United States Patent [19]

Gill

[11] Patent Number: 4,575,595

[45] Date of Patent: Mar. 11, 1986

[54] MODULAR POWER INTERFACE SYSTEM FOR PROVIDING POWER TO CARGO CONTAINERS

[76] Inventor: Michael J. Gill, 137 Orient Way, Apt. 3-C, Rutherford, N.J. 07070

[21] Appl. No.: 705,866

[22] Filed: Feb. 27, 1985

Related U.S. Application Data

[63] Continuation-in-part of Ser. No. 635,420, Jul. 30, 1984, abandoned.

[51] Int. Cl.[4] ..... H01H 9/20

[52] U.S. Cl. ..... 200/50 B

[58] Field of Search ..... 200/50, 50 B

[56] References Cited

U.S. PATENT DOCUMENTS

| | | | |
|---|---|---|---|
| 1,818,290 | 8/1931 | Wulle | 200/50 B |
| 2,295,499 | 9/1942 | Franck | 200/50 B X |
| 2,397,595 | 4/1946 | Conlan | 200/50 B |
| 3,315,059 | 4/1967 | Jacks et al. | 200/50 B X |

*Primary Examiner*—J. R. Scott

*Attorney, Agent, or Firm*—Stiefel, Gross, Kurland & Pavane

[57] ABSTRACT

A modular system (10) for interfacing a power source with cargo containers (16) requiring a source of power comprises a housing (12), at least one bus bar (22, 24, 26) secured in the housing (12) and connected to the power source, a plurality of modular units (14) receivable in chambers (20) in the housing (12), each modular unit (14) including a receptacle (48) secured to the front of the unit for receiving a cable plug (58) connected to a cargo container (16), means (96) electrically connecting the unit (14) to the bus bar when the unit is fully received in a chamber, a circuit breaker (72) in series with the receptacle (48) and the bus bar (22, 24, 26) via the connecting means (96), a switch (88) operable from the front of the unit for opening and closing the circuit breaker (72), locking means (118) behind the front panel (30) of the unit (14) and movable between a locking position wherein insertion of the cable plug (58) into the receptacle (48) is blocked and an unlocked position wherein the receptacle is unblocked, and means (120, 121) connecting the locking means (118) to the switch (88) for moving the locking means to the locking position when the switch (88) is operated to energize the circuit breaker (72) and to the unlocking position when the switch is operated to deenergize the circuit breaker (72). The invention also comprises the modular unit (14), the receptacle (48) the plug (58) for use with the modular system of the invention.

44 Claims, 9 Drawing Figures

REFRIGERATED CONTAINER
REFRIGERATED CONTAINER 10
12
14A
14B
14C
16
18
20
22
24
26
28
30
32
34
36
38
40
42
44
46
48
50
52
54
58
60
62
64
66
68
106
2
2

MODULAR POWER INTERFACE SYSTEM FOR PROVIDING POWER TO CARGO CONTAINERS

This is a continuation-in-part of application Ser. No. 635,420, filed July 30, 1984, now abandoned.

TECHNICAL FIELD

This invention pertains to systems for providing power to cargo containers of the type selectively transportable on transport tractors and ships.

BACKGROUND ART

Standardized cargo containers in the form of load-carrying trailers adapted for securement to chassis of transport tractors or to structural storage members aboard ship are widely in use. Many of these containers require power, e.g. containers incorporating refrigeration apparatus for regulating the temperature of the contents. When the containers are on board ship, power is commonly supplied from the ship's generator to receptacles strategically located in the ship's storage area and connected via cables to the individual containers. Typically, each receptacle has an associated circuit breaker, which can be manually activated to energize and deenergize the receptacle. When the containers are stored on shore, as on a dock, a similar arrangement of receptacles and cables is used, though power is supplied from some other source, e.g. municipal power. These arrangements, however, have several drawbacks.

A significant drawback is that the receptacles and circuit breakers are hard wired in place to such immovable objects as bulkheads aboard ship, steel poles sunk into pavement, concrete buffer walls, etc. Consequently, repair or replacement of a receptacle or circuit breaker must be accomplished on site, which almost invariably is an outdoor location exposed to the elements. Such maintenance can be uncomfortable in unpleasant weather, and can be seriously inhibited as in cold weather, where gloves worn for warmth limit the dexterity required for maintenance operations. Damp, wet conditions add a safety hazard, as the possibility of severe shock is an ever present danger at the power levels involved. As a consequence of the foregoing, the hard wired systems currently in use often go without maintenance during inclement conditions, which can extend over an entire winter season.

Another drawback of the available hard wired arrangements is that the cable plug does not have to be fully inserted in the receptacle to render the arrangement operational. The resulting high resistance at the connection points can result in heat build-up, which can eventually burn out the plug, the receptacle, and the circuit breaker.

Yet another drawback of the hard wired arrangements is that the available locking features for securing the plug to the receptacle are exposed to the elements. Consequently, it is not uncommon for these locking features to become iced over and rendered inoperable.

Yet an additional drawback is that the circuit breakers in the available hard wired arrangements are secured in place by a holding assembly configured to hold only a specific model of circuit breaker. Because circuit breakers are regularly obsoleted by manufacturers, this often results in extensive re-working or replacement of the holding assembly to accommodate a new breaker when an obsoleted breaker fails. This can result in the unit being out of service for an extended period of time, an obviously undesirable consequence. Yet an additional drawback of the hard wired arrangements is that some of the internal components are not corrosion resistant, and hence eventually break down and require replacement.

DISCLOSURE OF THE INVENTION

The present invention is a modular system incorporating a locking means which overcomes many drawbacks of the available hard wired systems described above. Defined broadly, the invention comprises a housing defining a plurality of openings in a wall thereof, each opening communicating with a chamber in the housing; at least one bus bar secured in the housing behind the chambers and adapted for connection to a power source; and a plurality of modular units receivable in the chambers through the openings, each unit comprising a frame having a front panel, a receptacle secured to the front panel and suitable for receiving a plug on a cable connected to a cargo container for providing power to the container from the power source, bus bar connecting means secured to the frame for electrical connection to the bus bar when the unit is fully received in one of the chambers, a circuit breaker secured to the frame and connected in series with the receptacle and the bus bar connecting means, switch means operable from the front of the panel for opening and closing the circuit breaker, locking means disposed behind the front panel for movement between a locking position wherein the locking means blocks insertion of the plug into the receptacle and an unlocking position wherein the locking means unblocks the receptacle, and means for operatively connecting the locking means to the switch means for moving the locking means to the locking position when the switch is operated to energize the circuit breaker and to the unlocking position when the switch is operated to deenergize the circuit breaker. The present invention also comprises the modular units, plugs and receptacles for use with the modular system of the invention.

The modular design of the system in accordance with the present invention significantly reduces down time and facilitates maintenance. By employing a modular system, a defective unit may be removed and replaced with an operable one, thereby eliminating on-site maintenance as required with hard wired systems and reducing associated down time. Moreover, repair of the defective unit can be performed indoors under ideal conditions, contrary to hard wired systems wherein maintenance is typically performed outdoors and is often completely neglected during extended periods of inclement weather. In the preferred system of the invention, the frame of each modular unit is of rectangular, open-sided construction, thereby accommodating easy access to internal components for maintenance purposes.

The locking means incorporated in each modular unit prevents the cable plug from being inserted into the receptacle whenever the receptacle is energized. That is, the locking means allows the cable plug to be inserted into the receptacle only when the circuit breaker is deenergized. Such an arrangement significantly reduces the hazard of shock. Also, in accordance with the preferred embodiment of the invention, a watertight seal is established between the front panel of the module and the housing once the module is secured in place. By thus preventing moisture from entering the housing, the problem of corrosion of the components of the modular unit is significantly reduced, if not eliminated, inasmuch as all of the corrosion prone components are disposed behind the front panel. This arrangement also prevents the movable components of the modular unit, and particularly the locking means which is also disposed behind the front panel, from becoming iced over and rendered inoperable.

In a preferred system in accordance with the present invention, the system further comprises a cable plug incorporating means cooperating with the locking means for preventing the switch from being operated to energize the circuit breaker unless the cable plug is fully inserted in the receptacle, and for preventing the cable plug from being withdrawn if the circuit breaker and hence the receptacle are energized. Such an arrangement prevents the possibility of damage to the plug, receptacle or circuit breaker resulting from resistive heating when the circuit breaker is energized and the cable plug not fully inserted in the receptacle. It also further reduces shock hazard by preventing the cable plug from being withdrawn as long as the receptacle remains energized.

In accordance with another preferred feature of the present invention, universal means are provided for mounting the circuit breakers in the modular units such that other and different circuit breakers may be substituted without modification to the mounting means. Also in accordance with a preferred aspect of the invention, all of the structural components are comprised of stainless steel to reduce damage from corrosion.

The foregoing as well as further features and advantages of the present invention will be more fully apparent from the following detailed description and annexed drawings of the current best mode thereof.

BRIEF DESCRIPTION OF THE DRAWINGS

In the drawings, wherein like numerals represent like parts.

BEST MODE FOR CARRYING OUT THE INVENTION

Figure 1:
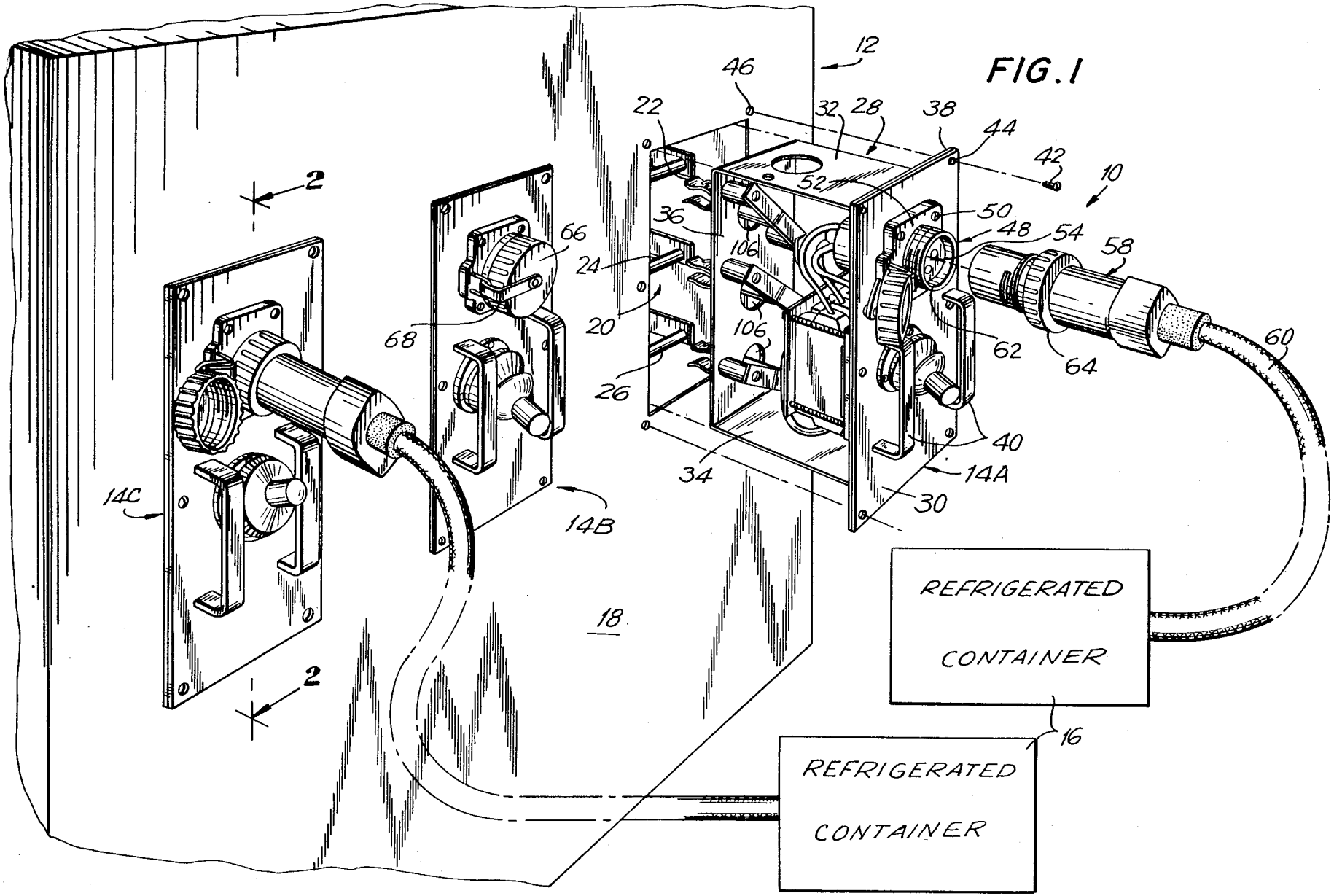
FIG. 1 is a perspective view of a modular system in accordance with the present invention.

Referring now to the drawings, and initially to FIG. 1 thereof, a preferred system 10 in accordance with the present invention includes a housing 12 and a plurality of modular units, shown by way of example as three modular units 14A, 14B, 14C. In accordance with the present invention, the system 10 provides an interface between an electric power source (not shown) and cargo containers requiring power, such as the refrigerated cargo containers diagrammatically represented at 16.

As best shown in FIG. 1, the housing 12 is preferably of rectangular construction and includes a front wall 18 having a plurality of openings 20 for receiving the modular units 14A, 14B, 14C. For purposes of clarity, the spacing between the units 14 in FIG. 1 is somewhat exaggerated and the actual preferred spacing now contemplated is about one and one-half inches. The housing 12 may be placed at any location where cargo containers requiring power are stored for any period of time, such as on board ship or on a loading dock. Where the housing 12 is stored on board ship, it may, for example, be installed on a bulkhead secured by bolts or any other suitable means (not shown) well known to the person of ordinary skill in the art. Housing 12 is constructed of stainless steel to minimize corrosion from exposure to the elements, as the system 10 will almost invariably be positioned outdoors.

As best shown in FIG. 1, a plurality of bus bars 22, 24, 26 extend across the interior of the housing 12 behind the openings 20. The bus bars 22, 24, 26 are connected to a power source (not shown), such as power generated on board ship, municipal power where the housing 12 is installed on a loading dock, or a separate, self-contained power supply specifically for use with the system 10. It is preferred that the power supply be connected to the bus bars 22, 24, 26 at one end of the housing 12 via suitable connectors extending through a side wall of the housing 12. Of course, the bus bars are insulated from the walls of the housing at either end thereof. As the details of such connections are well known to those of ordinary skill in the art, a further description thereof is unnecessary. In a typical situation, the bus bars 22, 24, 26 will each be connected to one lead of a 50 amp, 250 volt three phase system and the housing 12 will be grounded. However, it will be apparent to those of ordinary skill in the art who read this description that the system 10 may be employed with other power sources, and such persons will also recognize the modifications to the system 10 required to accommodate such other sources.

Figure 2:
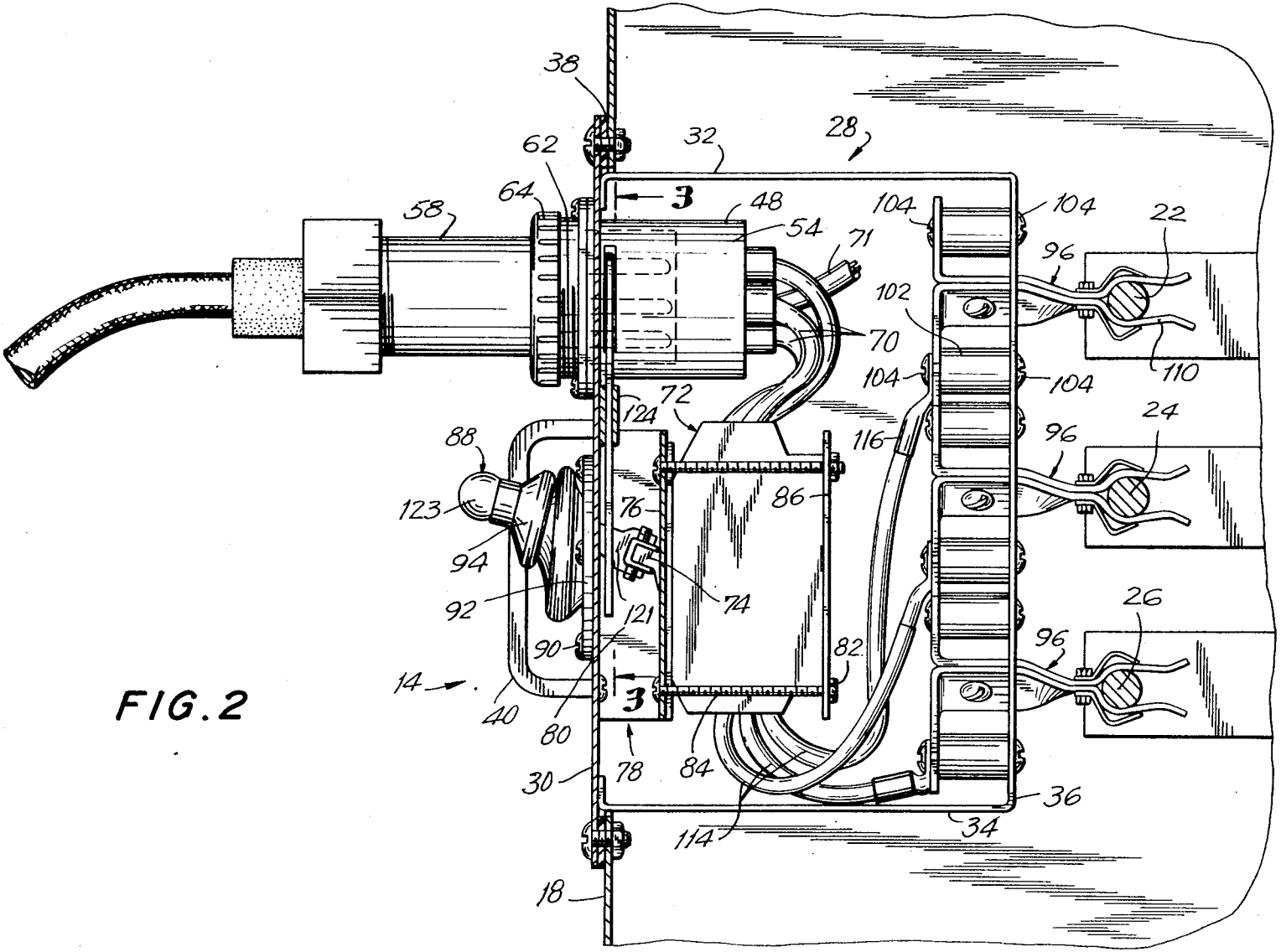
FIG. 2 is a sectional view taken substantially along the lines 2—2 in FIG. 1 showing the interior of a modular unit in accordance with the invention.

Referring initially to FIGS. 1 and 2, a typical unit 14 will now be described, it being understood that all the units 14 are identical and therefore interchangeable. As shown, each unit 14 includes a frame 28 defined by a front panel 30, top panel 32, bottom panel 34 and rear panel 36. The frame 28 is open sided to provide ready access for maintenance purposes. Top panel 32, bottom panel 34 and rear panel 36 comprise a single length of metal bent to a C-shape and secured to the front panel 30 by any suitable means, such as welding, bolts, etc. The frame 28, like the housing 12, is comprised of stainless steel.

A weather proofing gasket 38 is secured, as by a suitable adhesive, to the rear border of the front panel 30 to prevent the possibility of moisture entering the openings 20 when the unit 14 is in place. A pair of handles 40 are secured, as by welding, to the front face of the front panel 30 to facilitate insertion and removal of the unit 14 from the opening 20. When the unit 14 is fully inserted in the opening 20, it is retained in position by a plurality of bolts 42 extending through apertures 44 in the panel 30 and received in aligned internally threaded apertures 46 in the front wall 18 of the housing 12.

Still referring to FIGS. 1 and 2, a receptacle 48 is secured in an opening in the front panel 30 of the frame 28 as by a plurality of nuts and bolts 50 extending through aligned apertures in a flange 52 of the receptacle 48 and the front panel 30. The receptacle 48 has three electrically conductive sockets 54 for receiving corresponding prongs 56 of a male cable connector or plug 58 (hereinafter referred to as connector 58) secured to one end of a cable 60. As shown, sockets 54 are surrounded by an externally threaded collar 62 such that when the prongs 56 are fully inserted in the sockets 54, the freely rotatable internally threaded annular member 64 of the connector 58 may be screwed onto the collar 62 for securing the connector 58 to the receptacle 48 and for preventing the entry of moisture. When the receptacle 48 is not in use, it may be protected by an internally threaded cover member 66 pivotally secured to the receptacle flange 50 by a hinge 68. The cover member 66 is secured to the hinge 68 for free rotation such that the cover member 66 may be threaded onto the collar 62 when the cover member is pivoted to its closed position as shown with respect to the unit 14B in FIG. 1.

It should be noted that to the extent of the description given above, the receptacle 48 and the connector 58 are of conventional construction. For example, the receptacle 48 may comprise Model 5076M manufactured by Midland-Ross, Inc. and the connector 58 may comprise a Model 534MP also manufactured by Midland-Ross, Inc. However, and as will be described below, the receptacle 48 and connector 58 are modified in accordance with an important aspect of the present invention.

As best shown in FIG. 2, the rear end of each socket 54 is connected to one end of a wire 70. The other ends of the wires 70 are connected to one side of a conventional circuit breaker 72 which may comprise, for example, THQC 32050 manufactured by General Electric. The circuit breaker 72 incorporates the usual ON-OFF actuator 74 for activating and deactivating the circuit breaker. A fourth ground wire 71 extending from the receptacle 48 is grounded to the frame 28 in a known manner.

The circuit breaker 72 is mounted in the unit 14 between a bracket 78 and a backing plate 86. Bracket 78 is generally C-shaped and comprises a base plate 76 and a pair of legs 80 secured, as by welding, to the rear face of the front panel 30. The circuit breaker 72 is held in place by a plurality of nuts 82 and bolts 84, the bolts extending through aligned apertures in the base plate 76 and in the backing plate 86, the use of bolts 84 allowing the spacing between the backing plate 86 and base plate 76 to be easily adjusted. A hole is provided in the base plate 76 through which the actuator 74 extends. The above-described manner of securing the circuit breaker 72 in the unit 14 is highly desirable as it allows the circuit breaker to be readily and easily removed for maintenance or replacement purposes. It also allows the circuit breaker 72 to be replaced with a different circuit breaker having different dimensions without modification to the unit 14.

Figures 3, 4, 5, 6, 7, 8:
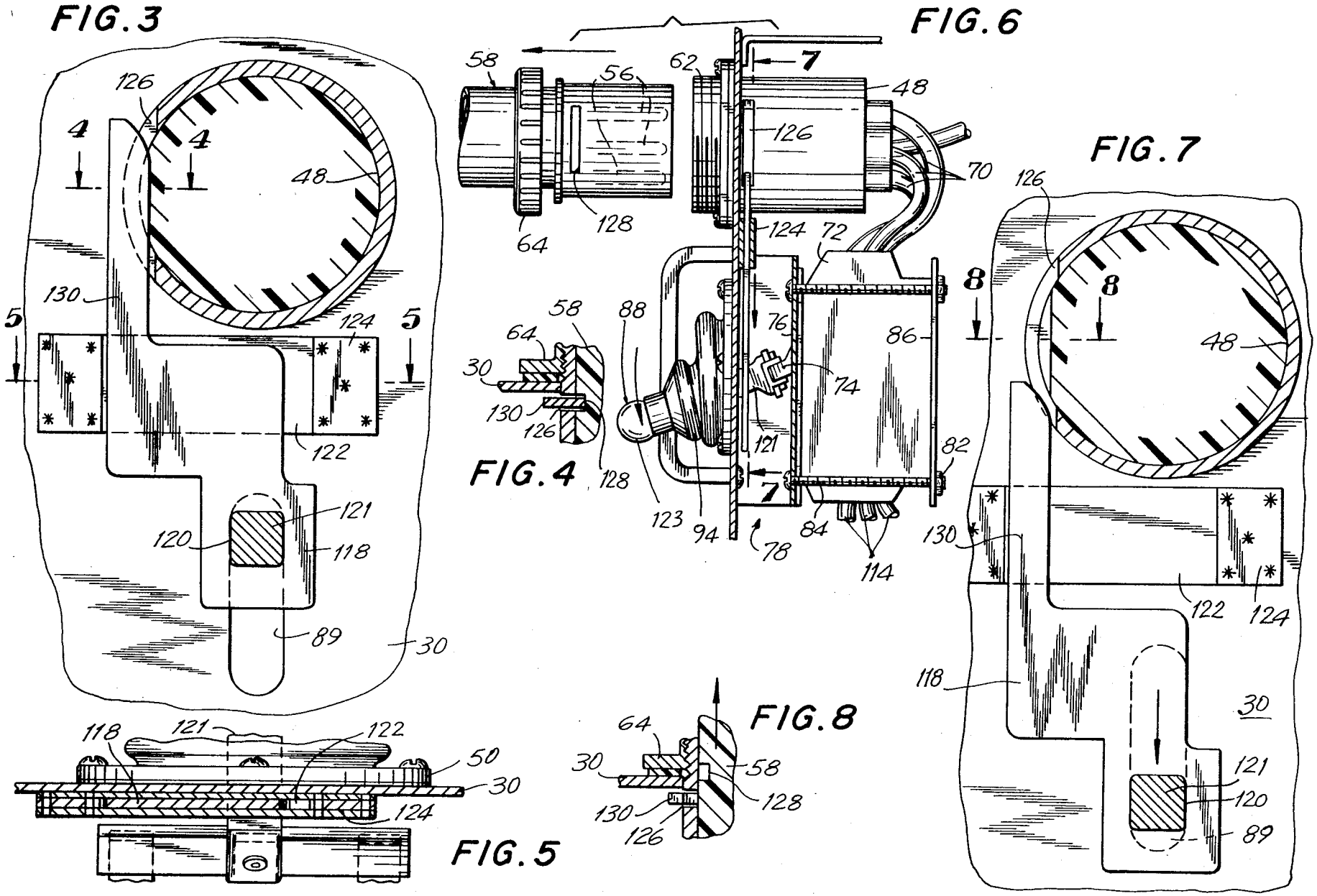
FIG. 3 is a sectional view taken substantially along the lines 3—3 in FIG. 2 showing the locking plate in the locking position.
FIG. 4 is a fragmentary sectional view taken substantially along the lines 4—4 in FIG. 3.
FIG. 5 is a sectional view taken substantially along the lines 5—5 in FIG. 3.
FIG. 6 is a partial view similar to FIG. 2 and illustrating the switch in the down or off position.
FIG. 7 is a sectional view taken substantially along the lines 7—7 in FIG. 6 and showing the locking plate in the unlocked position.
FIG. 8 is a fragmentary sectional view taken substantially along the lines 8—8 in FIG. 7.

Referring to FIGS. 2 and 3, an auxiliary actuator assembly (hereinafter referred to as switch 88) conjointly united with the actuator 74 extends through a slot 89 provided for that purpose in the front panel 30 and is secured at its rear end to the actuator 74, thereby allowing the actuator 74 to be activated from the front of the unit 14. The switch 88 is secured to the front panel 30 by a plurality of screws 90 which extend through apertures in a flange 92 of the switch 88 and are received in internally threaded apertures in the front panel 30. Preferably, and as shown, the switch 88 is of the type having a surrounding flexible rubber collar 94 to prevent moisture from entering the unit 14 through the slot 89.

As best shown in FIGS. 1 and 2, three electrically conductive connectors 96 are secured to the rear wall 36 of each unit 14, the connectors 96 being spaced for alignment with the bus bars 22, 24, 26. Each connector 96 is joined to the back wall 36 of the frame 28 by a pair of non-conducting stand offs having internally threaded bores 102 for receiving screws 104. As shown, the connectors 96 extend through holes 106 in the rear wall 36, the rear end of each connector defining a resilient clip 110 dimensioned for a friction connection about its aligned bus bar.

Referring to FIG. 2, three wires 114 join the circuit breaker 72 to the connectors 96 such that the circuit breaker is in series with the receptacle 48 and the bus bars 22, 24, 26. The wires 114 may be joined to the connectors 96 by terminal connectors 116 secured in place by the screws 104.

A feature of the present invention is the provision of a locking mechanism to prevent the connector 58 from being inserted into or removed from the receptacle 48 when the circuit breaker 72 is in the ON position. As discussed above, this is important for reasons of safety as well as to maximize the useful life of the units 14. Referring to FIGS. 2 through 8, this locking function is achieved in the preferred embodiment by an irregularly shaped locking plate 118. As shown in FIG. 3, the lower end of the locking plate 118 is provided with an aperture 120 through which the stem 121 of the switch 88 extends, the aperture 120 being only slightly larger than the cross-section of the stem 121. In this regard, the knob 123 of the switch 88 is removable to accommodate insertion of the stem 121 through the aperture 120.

The locking plate 118 extends through a guide slot 122 in a rectangular bracket 124 secured as by welding to the rear face of the front panel 30. The bracket 124 serves to retain the locking plate 118 adjacent the panel 30 while at the same time accommodating up and down sliding movement of the locking plate for reasons that will be explained below.

In accordance with the present invention, the receptacle 48 is modified by providing a through going slot 126 in the side wall thereof just behind the panel 30 such that the slot 126 lies in the same plane as the locking plate 118. Also in accordance with the invention, an indent 128 is provided in the side wall of the connector 58, the indent 128 being positioned such that it is in alignment with the slot 126 in the receptacle 48 when the prongs 56 are fully received in the sockets 54.

In operation, a modular unit 14 not in use will have the appearance of the unit 14B in FIG. 1 wherein the cover 66 is screwed onto the collar 62 of the receptacle 48. When it is desired to use the unit 14B, the cover 66 is removed thereby exposing the sockets 54. The cable connector 58 may then be inserted into the receptacle 48, provided the switch 88 is in the down or "OFF" position wherein the circuit breaker 72 is deenergized. When the connector 58 is fully inserted in the receptacle 48, the annular member 64 may then be screwed onto the collar 62 for retaining the connector 58 in the receptacle 48 and for preventing moisture entering the receptacle. The switch 88 may then be thrown to the up or "ON" position for energizing the circuit breaker 72 and completing the circuit path from the bus bars 22, 24, 26 to the refrigerated container 16. The elongate slot 89 in the front panel 30 accommodates up and down movement of the switch stem 121 as the switch 88 is moved between the OFF and ON positions. It should also be noted that when the plug 58 is inserted in the receptacle 48, the sidewall of the plug is received in an annular space between the sidewall of the receptacle and the sockets 54.

Referring to FIGS. 2–8, as the switch 88 is thrown to the up position energizing the circuit breaker 72, the locking plate 118 is also moved upward under the urging of the switch stem 121 which extends through aperture 120 in the locking plate, the locking plate being guided in its path of movement by the slot 122 in the bracket 124.

Figure 3A:
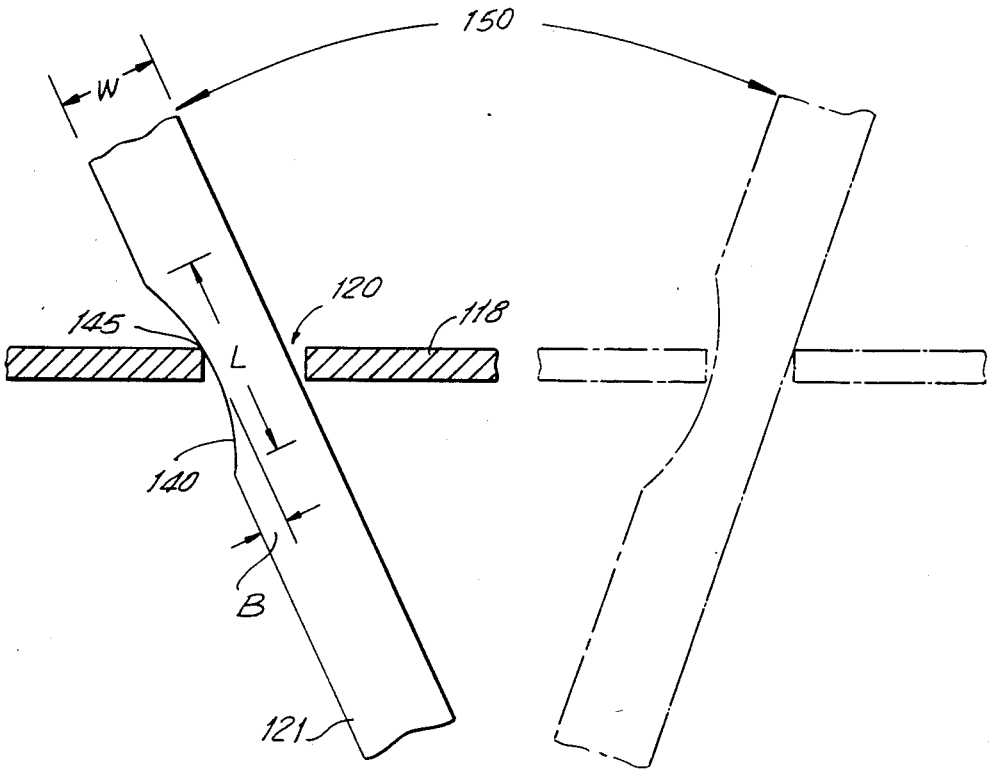
FIG. 3A is a partial sectional view of a switch stem and locking plate arrangement according to the present invention.

With reference to FIG. 3A, it can be seen that the switch stem 121 has a groove 140 such that an edge 145 of the locking plate 118 slidably engages the groove 140 as the switch stem 121 pivots back and forth through arc 150 as the switch 88 is activated and deactivated. Without the groove 140, as the switch stem 121 moves during such activation and deactivation, the switch stem 121 would bind in the aperture 120. Accordingly, the groove 140 is dimensioned such that the distance across the switch stem 121 in the plane of the locking plate 118 remains essentially constant throughout the arc of travel 150 of the switch stem 121. Thus, the groove 140 enables the maintenance of a close fit between the aperture 120 and switch stem 121 throughout the switch stem's entire arc of travel 150 without binding.

By way of example, a switch stem 121 having a width W of $\frac{1}{2}$ inch may be provided with a groove 140 having a maximum depth B of 3/32 of an inch and a length L of $\frac{7}{8}$ of an inch. The switch stem, when inserted in an aperture 120 having a width of $\frac{1}{2}$ inch will be capable of swinging through an arc 150 of sufficient magnitude to operate the toggle switch 88 without the switch stem 121 binding in the aperture 120.

As the locking plate 118 moves upward, the finger 130 at the upper end thereof moves into the slot 126 in the wall of receptacle 48. As shown, the finger 130 is sufficiently wide that a portion of the finger extends inside of the receptacle 48 (FIG. 3) and seats in the indent 128 in the wall of the connector 58. In this position, the connector 58 cannot be withdrawn from the receptacle 48 as it is locked in position by the finger 130. Consequently, the connector 58 cannot be withdrawn from the receptacle 48 as long as the circuit breaker is energized, i.e. the switch 88 is in the up position. Such an arrangement is highly desirable from a safety point of view as it prevents the connector 58 from being withdrawn while the receptacle 48 is "hot", thereby avoiding the possibility of a shock, which can be severe at the power levels involved.

When it is desired to remove the connector 58 from the receptacle 48, the switch 88 is thrown to the down or OFF position (FIG. 6) thereby deenergizing the circuit breaker 72 and simultaneously moving the locking plate 118 downward (FIG. 7). This retracts the locking plate finger 130 from indent 128 and slot 126 whereupon the connector 58 may be withdrawn in the usual manner.

The locking arrangement according to the present invention also prevents the switch 88 from being thrown to the up position for energizing the circuit breaker 72 if the connector 58 is not fully inserted into the receptacle 48. That is, if the indent 128 is not aligned with the slot 126 when it is attempted to throw the switch 88 to the up position, the upper end of the locking plate finger 130 will strike the side wall of the connector 58 thereby blocking any further upward movement. Further upward movement can then be accomplished only if the receptacle 58 is fully inserted whereupon the finger 130 will slide into the indent 128. This is also highly desirable, as partial insertion of the connector 58 into the receptacle 48, while perhaps sufficient to convey power from the bus bars 22, 24, 26 to the refrigerated container 16, will result in a high resistance connection with consequent overheating and power loss and damage to the affected components.

It will be evident that for the locking arrangement of the present invention to function properly, connector 58 must be properly oriented upon insertion into the receptacle 48 such that the indent 128 will be aligned with the slot 126. This, however, is not a problem, as the prongs 56 and sockets 54 of currently available connectors and receptacles, e.g. those mentioned above, are non-symmetrically distributed such that only one possible alignment of the connector 58 and receptacle 48 is possible.

The arrangement according to the present invention also prevents the connector 58 from being inserted into the receptacle 48 when the circuit breaker 72 is energized. Thus, and as best shown in FIG. 3, when the switch 88 is in the up position energizing the circuit breaker 72, finger 130 protrudes inside the receptacle. Consequently, if it is then attempted to insert the connector 58, the connector will strike the finger thereby preventing further inward movement. This will immediately alert the user that the circuit breaker is energized and force the user to throw the switch 88 to the down position (FIGS. 6 and 7), thereby deenergizing the circuit breaker and removing any possible hazard.

It is also significant that the preferred system 10 defines a watertight arrangement which significantly reduces, if not prevents, corrosion of the components of the modular unit 14 and avoids the possibility of the movable components becoming iced over and thereby rendered inoperable. That is, when the modular unit 14 is in place, the weather proofing gasket 38 prevents moisture from entering the housing through the openings 20. Seepage of moisture around the switch 88 is prevented by the rubber collar 94 which, as shown in FIG. 2, surrounds the switch and effectively prevents the entry of moisture. Also, the interior of the receptacle 48 is protected from moisture either by the cap 66 when the unit 14 is not in use, or by the watertight seal between the connector 58 and the receptacle during use. Consequently, all the moisture sensitive components of the unit 14 are kept dry. This not only extends their useful life, but also prevents movable components, and in particular the locking mechanism, from becoming iced over and rendered inoperable. When there is no modular unit 14 in a particular opening 20, a watertight seal is maintained by a cover plate fitted with an appropriate weather proofing gasket.

Another important advantage of the arrangement in accordance with the present invention is that it permits ready servicing of the unit 14. Thus, if there is a defect in a particular unit 14, as may occur, for example, if a circuit breaker or receptacle fails, service personnel can remove the damaged unit 14 by simply removing the screws 42, replace the damaged unit with a fully operable one or with a cover plate, and take the damaged unit to an indoor shop or other location for servicing under ideal conditions. The open sides of the units 14 facilitate maintenance work. Another important advantage of the system 10 is that it requires little modification to components currently in use. The only modification required to conventional receptacles 48 is the provision of a slot 126 in the side wall thereof. Similarly, the only modification required to currently available connectors 58 is the provision of an indent 128 in the outer wall thereof, whereupon the modified connectors 58 can be substituted for conventional connectors now in use. Alternatively, an interface could readily be devised for disposition between a conventional connector and the receptacle 48. The interface would have a female end for receiving the prongs of the conventional connector and a male end having prongs dimensioned for insertion into the receptacle 48. The male end would be provided with an indent 128 to accommodate operation with the locking plate 118. Such interface connectors could then be used in lieu of replacing each conventional connector with a connector 58 incorporating an indent 128.

While I have herein shown and described a preferred embodiment of the present invention and have suggested certain changes and modifications thereto, persons of ordinary skill in the art will recognize that still further changes and modifications may be made therein without departing from the spirit and scope of the invention. Accordingly, the above description should be construed as illustrative, and not in the limiting sense, the scope of the invention being defined by the following claims.

I claim:

1. A system for interfacing a power source with cargo containers requiring a source of power, comprising:

a housing defining a plurality of openings in a wall thereof, each opening communicating with a chamber in said housing;

means secured in said housing for electrical connection to said power source;

a plurality of modular units receivable in said chambers through said openings, each unit comprising (a) a frame having a front panel;

(b) a receptacle secured to said front panel and suitable for receiving a plug on a cable connected to a cargo container for providing power from said power source to said container;

(c) means secured to said frame for electrical connection to said power source connection means when the unit is fully received in a chamber;

(d) circuit breaker means secured to said frame and connected in series with said receptacle and said bus bar connecting means;

(e) switch means operable from said front panel for opening and closing said circuit breaker means;

(f) locking means disposed behind said front panel for movement between a locking position wherein said locking means blocks insertion of said plug into said receptacle and an unlocking position wherein said locking means unblocks said receptacle; and (g) means for operatively connecting said locking means to said switch means for moving said locking means to said locking position when said switch means is operated to energize said circuit breaker means and to said unlocking position when said switch means is operated to deenergize said circuit breaker means.

2. The system according to claim 1, and further comprising a slot in said receptacle, and wherein said locking means includes a portion extending into said receptacle through said slot when said locking means is in said locking position.

3. The system according to claim 2, wherein said plug connector comprises an element of said system, said plug connector having an indent therein positioned for alignment with said slot in said receptacle when said plug connector is fully inserted therein, said locking means portion seating in said indent when said locking means is in said locking position for preventing withdrawal of said plug connector when said circuit breaker is energized.

4. The system according to claim 3, wherein said indent is in a sidewall of said plug connector, said locking means striking an unindented portion of said sidewall when said plug connector is not fully inserted in said receptacle and it is attempted to operate said switch to energize said circuit breaker, whereby said circuit breaker cannot be energized unless said plug connector is fully inserted in said receptacle.

5. The system according to claim 4, wherein said operative connecting means comprises said front panel having a slot therein, said locking means having an aperture therein, and said switch means including a stem extending through said slot and said aperture, said stem having a groove at a point where said stem passes through said aperture to permit said stem to pivot in said aperture without jamming during movement of said locking means between said locking and unlocking positions.

6. The system according to claim 5, and further comprising a bracket having a slot therein secured to the rear face of said front panel, said locking means extending through said slot and being guided thereby in its path of travel between said locking and unlocking positions.

7. The system according to claim 6, and further comprising a base plate secured to said frame, a backing plate, and means for joining said base plate to said backing plate in adjustable spaced apart relation, said circuit breaker being secured to said frame by disposition between said base plate and said backing plate.

8. The modular unit according to claim 7, wherein said means secured in said housing for connection to the power source comprises a bus bar, and wherein said means secured to said frame for electrical connection to said bus bar comprises bus bar connecting means.

9. The system according to claim 8, and further comprising means for establishing a watertight seal between the respective front panel of a modular unit and said housing wall when said modular unit is received in its respective opening in said housing wall.

10. The system according to claim 9, wherein said frame is generally rectangular and open-sided.

11. The system according to claim 10, wherein the structural components of said system are comprised of a corrosion resistant material.

12. The system according to claim 11, wherein said material comprises stainless steel.

13. The modular unit according to claim 1, wherein said means secured in said housing for connection to the power source comprises a bus bar, and wherein said means secured to said frame for electrical connection to said bus bar comprises bus bar connecting means.

14. The system according to claim 1, and further comprising means for establishing a watertight seal between the respective front panel of a modular unit and said housing wall when said modular unit is received in its respective opening in said housing wall.

15. The system according to claim 1, wherein said operative connecting means comprises said front panel having a slot therein, said locking means having an aperture therein, and said switch means including a stem extending through said slot and said aperture, said stem being dimensioned to substantially fully occupy said aperture.

16. The system according to claim 1, and further comprising a bracket secured to the rear face of said front panel and having a slot therein, said locking means extending through said slot and being guided thereby in its path of travel between said locking and unlocking positions.

17. The system according to claim 1, and further comprising a base plate secured to said frame, a backing plate, and means for joining said base plate to said backing plate in adjustable spaced apart relation, said circuit breaker being secured to said frame by disposition between said base plate and said backing plate.

18. The system according to claim 1, wherein said frame is generally rectangular and open-sided.

19. The system according to claim 1, wherein the structural components of said system are comprised of a corrosion resistant material.

20. The system according to claim 19, wherein said material comprises stainless steel.

21. A modular unit for use with a system for interfacing a power source with cargo containers requiring a source of power, said system being of the type including a housing defining a plurality of openings in a wall thereof communicating with chambers in the housing, means secured in the housing for electrical connection to the power source, the modular unit comprising:

(a) a frame having a front panel;

(b) a receptacle secured to said front panel and suitable for receiving a plug on a cable connected to a cargo container for providing power from said power source to said container;

(c) means secured to said frame for electrical connection to said power source connection means when the unit is fully received in a chamber;

(d) circuit breaker means secured to said frame and connected in series with said receptacle and said power source connecting means;

(e) switch means operable from said front panel for opening and closing said circuit breaker means;

(f) locking means disposed behind said front panel for movement between a locking position wherein said locking means blocks insertion of said plug into said receptacle and an unlocking position wherein said locking means unblocks said receptacle; and (g) means for operatively connecting said locking means to said switch means for moving said locking means to said locking position when said switch means is operated to energize said circuit breaker means and to said unlocking position when said switch means is operated to deenergize said circuit breaker means.

22. The modular unit according to claim 21, and further comprising a slot in said receptacle, and wherein said locking means includes a portion extending into said receptacle through said slot when said locking means is in said locking position.

23. The modular unit according to claim 22, wherein said plug connector comprises an element of said system, said plug connector having an indent therein positioned for alignment with said slot in said receptacle when said plug connector is fully inserted therein, said locking means portion seating in said indent when said locking means is in said locking position for preventing withdrawal of said plug connector when said circuit breaker is energized.

24. The modular unit according to claim 23, wherein said indent is in a sidewall of said plug connector, said locking means striking an unindented portion of said sidewall when said plug connector is not fully inserted in said receptacle and it is attempted to operate said switch to energize said circuit breaker, whereby said circuit breaker cannot be energized unless said plug connector is fully inserted in said receptacle.

25. The modular unit according to claim 24, wherein said operative connecting means comprises said front panel having a slot therein, said locking means having an aperture therein, and said switch means including a stem extending through said slot and said aperture, said stem having a groove at a point where said stem passes through said aperture to permit said stem to pivot in said aperture without jamming during movement of said locking means between said locking and unlocking positions.

26. The modular unit according to claim 25, and further comprising a bracket secured to the rear face of said front panel and having a slot therein, said locking means extending through said slot and being guided thereby in its path of travel between said locking and unlocking positions.

27. The modular unit according to claim 26, wherein said means secured in said housing for connection to the power source comprises a bus bar, and wherein said means secured to said frame for electrical connection to said bus bar comprises bus bar connecting means.

28. The system according to claim 27, and further comprising means for establishing a watertight seal between each respective modular unit and said housing.

29. The modular unit according to claim 28, and further comprising a base plate secured to said frame, a backing plate, and means for joining said base plate to said backing plate in adjustable spaced apart relation, said circuit breaker being secured to said frame by disposition between said base plate and said backing plate.

30. The modular unit according to claim 29, wherein said frame is generally rectangular and open-sided.

31. The modular unit according to claim 30, wherein the structural components of said system are comprised of a corrosion resistant material.

32. The modular unit according to claim 31, wherein said material comprises stainless steel.

33. The modular unit according to claim 21, wherein said operative connecting means comprises said front panel having a slot therein, said locking means having an aperture therein, and said switch means including a stem extending through said slot and said aperture, said stem being dimensioned to substantially fully occupy said aperture.

34. The modular unit according to claim 21, and further comprising a bracket secured to the rear face of said front panel and having a slot therein, said locking means extending through said slot and being guided thereby in its path of travel between said locking and unlocking positions.

35. The modular unit according to claim 21, wherein said means secured in said housing for connection to the power sources comprises a bus bar, and wherein said means secured to said frame for electrical connection to said bus bar comprises bus bar connecting means.

36. The system according to claim 21, and further comprising means for establishing a watertight seal between each respective modular unit and said housing.

37. The modular unit according to claim 21, and further comprising a base plate secured to said frame, a backing plate, and means for joining said base plate to said backing plate in adjustable spaced apart relation, said circuit breaker being secured to said frame by disposition between said base plate and said backing plate.

38. The modular unit according to claim 21, wherein said frame is generally rectangular and open-sided.

39. The modular unit according to claim 21, wherein the structural components of said system are comprised of a corrosion resistant material.

40. The modular unit according to claim 39, wherein said material comprises stainless steel.

41. In a plug connector intended for use with a modular unit suitable for interfacing a power source with a cargo container, the modular unit being of the type including a frame having a front panel, a receptacle for receiving the plug secured to the front panel, the receptacle having a slot therein positioned behind said front panel, a circuit breaker secured to the frame and connected in series with the receptacle and the power source, a switch operable from the front panel for opening and closing the circuit breaker, locking means disposed behind the front panel for movement between a locking position wherein a portion of the locking means extends into the receptacle through the slot and an unlocking position wherein the locking means is retracted from the slot for unblocking the receptacle, and means operatively connecting the locking means to the switch for moving the locking means to the locking position when the switch is operated to energize the circuit breaker and to the unlocking position when the switch is operated to deenergize the circuit breaker, the improvement comprising:

said plug connector having an indent therein positioned for alignment with said slot in said receptacle when said plug connector is fully inserted therein, said locking means portion seating in said indent when said locking means is in said locking position for preventing withdrawal of said plug connector when said circuit breaker is energized.

42. The plug connector according to claim 41, wherein said indent is in a sidewall of said plug connector, said locking means striking an unindented portion of said sidewall when said plug connector is not fully inserted in said receptacle and it is attempted to operate said switch to energize said circuit breaker, whereby said circuit breaker cannot be energized unless said plug connector is fully inserted in said receptacle.

43. In receptacle intended for use with a modular unit suitable for interfacing a power source with a cargo container via a cable having a plug at one end thereof, the modular unit being of the type including a frame having a front panel, an opening in the front panel for receiving the receptacle, a circuit breaker secured to the frame and connected in series with the receptacle and the power source when the unit is in use, a switch operable from the front panel for opening and closing the circuit breaker, locking means disposed behind the front panel for movement between a locking position wherein insertion of the plug into the receptacle is blocked and an unlocking position wherein said receptacle is unblocked, and means operatively connecting the locking means to the switch for moving the locking means to the locking position when the switch is operated to energize the circuit breaker and to the unlocking position when the switch is operated to deenergize the circuit breaker, the improvement comprising:

the receptacle having a slot therein positioned for alignment with a portion of said locking means, said locking means portion extending into said receptacle through said slot when said switch is operated to energize said circuit breaker and said locking means is moved to said locking position, said locking means portion being retracted from said slot when said switch is operated to deenergize said circuit breaker and said locking means is moved to said unlocking position.

44. The receptacle according to claim 43, wherein said slot is in a sidewall of said receptacle.

* * * * *